US007571789B2

(12) United States Patent
Gilli

(10) Patent No.: US 7,571,789 B2
(45) Date of Patent: Aug. 11, 2009

(54) MUFFLER FOR EXHAUST SYSTEMS OF VEHICLES

(75) Inventor: Alessandro Gilli, Mantova (IT)

(73) Assignee: Supersprint S.R.L., Mantova (IT)

( * ) Notice: Subject to any disclaimer, the term of this patent is extended or adjusted under 35 U.S.C. 154(b) by 183 days.

(21) Appl. No.: 10/589,248

(22) PCT Filed: Mar. 21, 2005

(86) PCT No.: PCT/IB2005/000731

§ 371 (c)(1),
(2), (4) Date: Aug. 14, 2006

(87) PCT Pub. No.: WO2005/093228

PCT Pub. Date: Oct. 6, 2005

(65) Prior Publication Data

US 2007/0187175 A1 Aug. 16, 2007

(30) Foreign Application Priority Data

Mar. 26, 2004 (IT) ..... TO20040041 U

(51) Int. Cl.
*F01N 1/04* (2006.01)

(52) U.S. Cl. ..... 181/251; 181/239; 181/257; 181/268; 181/274; 181/275

(58) Field of Classification Search ..... 181/238, 181/239, 251, 257, 268, 275, 274
See application file for complete search history.

(56) References Cited

U.S. PATENT DOCUMENTS 2,070,543 A * 2/1937 Hollerith et al. ..... 181/266
2,934,161 A * 4/1960 Powers ..... 181/266
3,511,617 A 5/1970 Lyben
4,381,045 A * 4/1983 Buchwalder ..... 181/265
4,396,090 A * 8/1983 Wolfhugel ..... 181/282
5,014,817 A * 5/1991 Takato et al. ..... 181/254
5,581,056 A * 12/1996 Bellgardt et al. ..... 181/282
6,105,717 A * 8/2000 Kleukers ..... 181/282
2002/0033304 A1* 3/2002 Watanabe et al. ..... 181/275
2002/0079160 A1* 6/2002 Chen ..... 181/251

FOREIGN PATENT DOCUMENTS

DE 37 16 248 A1 11/1987
DE 199 48 146 A1 3/2001
EP 0 935 057 A 8/1999
FR 1 258 458 A 4/1961

* cited by examiner

*Primary Examiner*—Jeffrey Donels
*Assistant Examiner*—Jeremy Luks
(74) *Attorney, Agent, or Firm*—Modiano & Associati; Albert Josif; Daniel J. O'Byrne

(57) ABSTRACT

The muffler comprises a tubular shell which is internally lined with a noise-deadening material and is closed at its ends by a front wall provided with an inlet connectable to receive exhaust gas, and by a rear wall. A first chamber and a second chamber, which are separated by a transverse wall having an inlet opening and an outlet opening, are defined within the tubular shell. A perforated inlet pipe extends within first chamber from the inlet to the inlet opening. Gas-piping elements extend within the first chamber and have one end open to the outlet opening, and another end connectable to the exhaust pipes. The inlet opening and the outlet opening are substantially equal in diameter to the inlet pipe, and are interconnected via a toroidal duct that is arranged within the second chamber and is substantially equal in diameter to the inlet pipe.

6 Claims, 2 Drawing Sheets

10
12
14
16
18
19
20
22
24
26
28
30
32
36
38
40
42
43
44
50
M
L 30
40
40a
38
42
42a
34
43

MUFFLER FOR EXHAUST SYSTEMS OF VEHICLES

BACKGROUND OF THE INVENTION

Exhaust systems in modern cars are provided with mufflers comprising a shell which is internally lined with a noise-deadening material, typically rock wool. The exhaust gas in the shell is piped into an insulated chamber, sometimes known as "reflection chamber", via a first pipe, and then to one/more intermediate pipes joined to the exhaust pipes. Since turbulences and counter-pressures inside the insulated chamber considerably affect the power performance of the engine, it is also known to convey the gas flow within the insulated chamber via a connecting box having perforations over its entire surface and provided with two side holes for connection to respective exhaust pipes.

Although the above arrangement is satisfactory as far as noise-deadening is concerned, however it is not satisfactory in terms of performance of the engine, because the profile of the perforated box hinders the optimal flow of the exhaust gas.

SUMMARY OF THE INVENTION

Therefore, it is a main object of the present invention to provide a muffler for exhaust systems in vehicles which substantially has the same effectiveness of the above known mufflers in relation to noise-deadening, while providing a higher performance of the engine.

The above and other objects and advantages, which will better appear below, are achieved by the muffler having the features recited in claim 1, while the other claims state other advantageous, though secondary features of the invention.

BRIEF DESCRIPTION OF THE DRAWINGS

The invention will be now described in more detail, with reference to the attached drawings shown by way of non-limiting example, wherein.

DESCRIPTION OF THE PREFERRED EMBODIMENTS

Figures 1, 3:
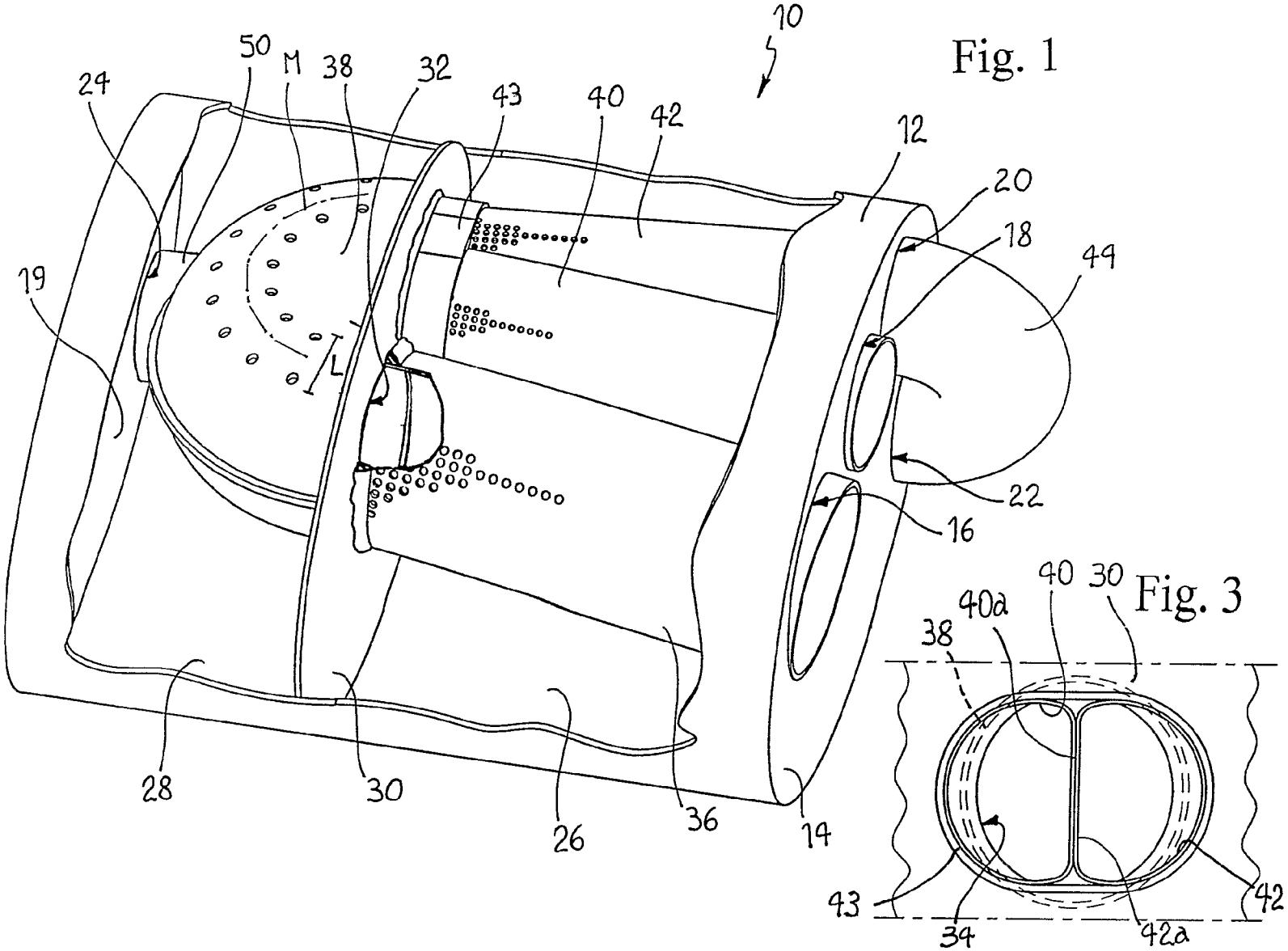
FIG. 1 is a perspective, broken-away view of a muffler according to the invention.
FIG. 3 is view in cross-section of a detail of the muffler of FIG. 1 along line III-III of FIG. 2.
Figure 2:
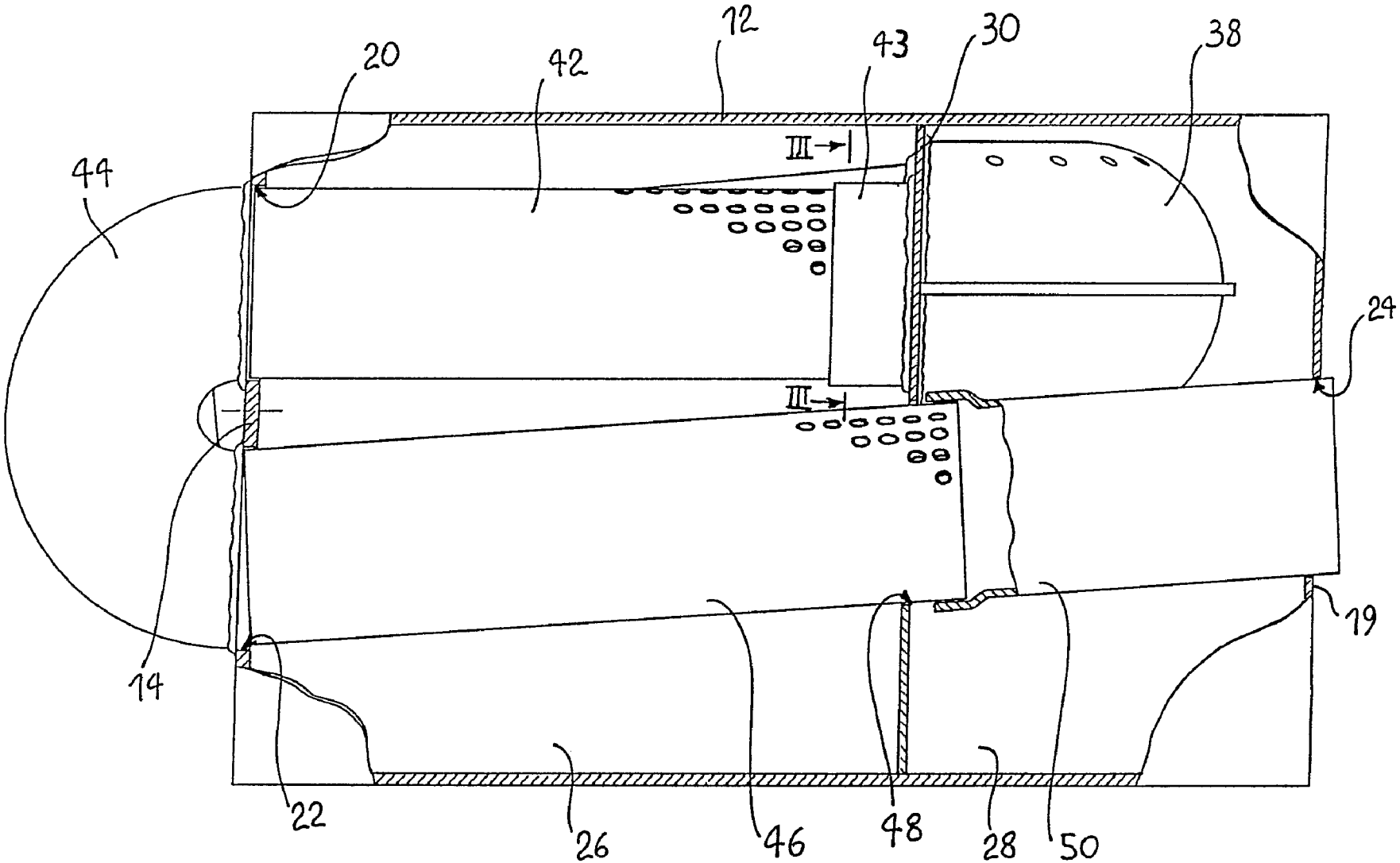
FIG. 2 is a broken-away, side view of the muffler of FIG. 1.

With reference to the above figures, a muffler 10 comprises a tubular shell 12 having an elliptical profile. Shell 12 is closed at its longitudinal ends by a front wall 14 provided with an inlet 16 for connection to the exhaust system (not shown), with a pair of outlets 18, 20 and with a reflux hole 22, as well as by a rear wall 19 having an exhaust outlet 24. A first chamber 26 and a second chamber 28, separated by a transverse wall 30 having an inlet opening 32 and an outlet opening 34 (FIG. 3), are defined within tubular shell 12.

An inlet pipe 36 having perforations over its entire surface (though in the figures, for better clarity, perforations are only illustrated over a portion of the surface) extend within first chamber 26 from front wall 14, to which it is welded at inlet 16, to transverse wall 30, to which it is welded at inlet opening 32.

According to this invention, inlet opening 32 and outlet opening 34 on transverse wall 30 are substantially equal in diameter to inlet pipe 36, and are interconnected via a toroidal duct 38 arranged within second chamber 28, which is substantially equal in diameter to inlet pipe 36.

Toroidal duct 38 has perforated bands, of a width L substantially equal to ⅙ of the duct perimeter, and extending on the upper surface and lower surface of the duct, astride the median line M of the torus.

Gas-piping means are arranged within first chamber 26, which comprise a pair of intermediate perforated pipes 40, 42 projecting along two diverging axes from outlet opening 34 to outlets 18, 20. In particular, in order to enhance the outflow of the exhaust gas from second chamber 28, the converging ends of perforated pipes 40, 42 coalesce into a joint 43 welded to outlet opening 34, and are in contact along respective flattened surfaces 40*a*, 42*a*, so that their profile at transverse wall 30 substantially matches with the profile of the opening (FIG. 3).

A toroidal joint 44 has two ends externally welded to front wall 14 at outlet 20 and at reflux hole 22 respectively. An outlet pipe, comprising an end pipe 46 also having perforations over its entire surface, is internally welded to reflux hole 22. End pipe 46 leads into second chamber 28 through a port 48, where it is surrounded by a tail pipe 50 leading outside through exhaust outlet 24 on the rear wall.

Further external tail pipes (not shown) are connected to the other outlet (outlet 18 in the example).

Tubular shell 12 is filled with a noise-deadening material, e.g. rock wool or glass wool (not shown). All the perforated pipes, as well as toroidal duct 38, are lined with stainless steel wool (not shown).

The above-described muffler is connected downstream of the exhaust system to receive exhaust gas into inlet 16, similarly to the traditional mufflers. The gas is conveyed along a sinuous path inside the muffler via inlet pipe 36, toroidal duct 38, perforated pipes 40, 42, toroidal joint 44, end pipe 46 and tail pipe 50. The perforations in the pipes, in combination with the noise-deadening lining, provide the desired noise-deadening action, as well known to those persons skilled in the art.

It has been found in practice that the above described muffler for exhaust systems substantially has the same effectiveness, in relation to noise-deadening, of known mufflers provided with a reflection chamber, with improved performance of the engine, due to the fact that the gas within the muffler is conveyed without hindrances along a sinuous path having a substantially constant profile, so that the areas of turbolence are reduced. Also, since the toroidal duct is free of perforations along an outermost band of its surface, where the exhaust gas reaches its higher speed, the flow is not slowed down or hindered by any perforations. The perforations are only along two bands on the upper surface and on the lower surface of the duct. In particular, it has been found that better effectiveness is achieved with a perforated band having a width L in the range ⅛ to ¼ of the perimeter of the toroidal duct, preferably ⅙.

According to a first alternative embodiment of the invention, not shown in the figures, outlet 18, similarly to outlet 20, is also connected for recirculating the exhaust gas into the muffler. Accordingly, a second toroidal joint is externally welded at its ends to front wall 14, at outlet 18 and at a second reflux hole. A second perforated end pipe, provided with a tail pipe similar to pipe 46, projects into the shall from the second reflux hole.

According to a second alternative embodiment of the invention, not shown in the figures, end pipe 46 and tail pipe 50 are substituted by a pair of diverging, perforated pipes projecting from outlet 18 or 20, similarly to middle pipes 40,

42. Each pipe is provided with a respective tail pipe extending within second chamber 28 and leading to a respective exhaust port on the rear wall.

A preferred embodiment of the invention has been described herein, but of course many changes may be made by a person skilled in the art, depending on the circumstances, within the scope of the inventive concept. For example, the tubular shell could have a circular profile or a squared profile.

The invention claimed is:

1. A muffler for exhaust systems of vehicles, comprising a tubular shell that is internally lined with a noise-deadening material and is closed at its ends by a front wall provided with an inlet connectable to receive exhaust gas, and by a rear wall, a first chamber and a second chamber being defined within the tubular shell, which are separated by a transverse wall having an inlet opening and an outlet opening, a perforated inlet pipe extending within the first chamber from the inlet to the inlet opening, gas-piping means extending within the first chamber and having one end open to said outlet opening, and the other end connectable to exhaust pipes, wherein said inlet opening and outlet opening are substantially equal in diameter to the inlet pipe, and are connected to each other via a toroidal duct that is arranged within the second chamber and is substantially equal in diameter to the inlet pipe; and wherein said gas-piping means comprise a pair of perforated pipes having two converging ends welded to said outlet opening and in mutual contact along respective flattened surfaces, so that their profile at said transverse wall substantially matches with the profile of the outlet opening.

2. The muffler of claim 1, wherein said toroidal duct has perforated bands of a width in the range ⅛ to ¼ of the duct perimeter, and extending on the upper surface and on the lower surface of the duct astride the median line of the torus.

3. The muffler of claim 2, wherein the width of said bands is equal to ⅙ of the duct perimeter.

4. The muffler of claim 1, wherein said front wall has at least one outlet, and in that a corresponding one of said perforated pipes leads to said outlet to be connected to exhaust pipes external to the shell.

5. The muffler of claim 4, wherein said front wall also has a first reflux hole, and comprising a toroidal joint having two ends which are externally welded to said front wall at said outlet and at said reflux hole respectively, and an outlet pipe extending inside the shell from said reflux hole to an exhaust outlet on the rear wall.

6. The muffler of claim 5, wherein said outlet pipe comprises a perforated end pipe extending from said front wall to a port on said transverse wall, and a tail pipe extending from said port to said exhaust outlet.

* * * * *